US005230751A

United States Patent [19]

Endoh et al.

[11] Patent Number: 5,230,751

[45] Date of Patent: Jul. 27, 1993

[54] PERMANENT MAGNET WITH GOOD THERMAL STABILITY

[75] Inventors: Minoru Endoh, Kumagaya; Masaaki Tokunaga, Fukaya; Hiroshi Kogure, Kumagaya, all of Japan

[73] Assignee: Hitachi Metals, Ltd., Tokyo, Japan

[21] Appl. No.: 711,261

[22] Filed: Jun. 4, 1991

Related U.S. Application Data

[60] Division of Ser. No. 298,850, Jan. 19, 1989, abandoned, which is a continuation of Ser. No. 72,045, Jul. 10, 1987, abandoned.

[30] Foreign Application Priority Data

| | | | |
|---|---|---|---|
| Jul. 23, 1986 | [JP] | Japan | 61-172987 |
| Aug. 7, 1986 | [JP] | Japan | 61-185905 |
| Oct. 14, 1986 | [JP] | Japan | 61-243490 |
| Jan. 6, 1987 | [JP] | Japan | 62-857 |

[51] Int. Cl.[5] ..... H01F 1/053

[52] U.S. Cl. ..... 148/302; 75/244; 420/83; 420/121

[58] Field of Search ..... 148/302; 428/83, 121; 75/244

[56] References Cited

U.S. PATENT DOCUMENTS

| | | | |
|---|---|---|---|
| 4,402,770 | 9/1983 | Koon . | |
| 4,859,254 | 8/1989 | Mizoguchi et al. | 148/302 |
| 4,935,075 | 6/1990 | Mizoguchi et al. | 148/302 |

FOREIGN PATENT DOCUMENTS

| | | | |
|---|---|---|---|
| 0134304 | 3/1985 | European Pat. Off. | 148/302 |
| 0216254 | 4/1987 | European Pat. Off. . | |
| 0248981 | 12/1987 | European Pat. Off. . | |
| 60-221549 | 11/1985 | Japan . | |
| 60-238447 | 11/1985 | Japan | 148/302 |
| 62-136551 | 12/1985 | Japan . | |
| 60-243247 | 12/1985 | Japan | 148/302 |
| 61-51901 | 3/1986 | Japan | 148/302 |
| 61-147503 | 7/1986 | Japan | 148/302 |
| 61-263201 | 11/1986 | Japan . | |
| 136551 | 6/1987 | Japan . | |
| 101552 | 2/1984 | United Kingdom . | |
| 106948 | 5/1984 | United Kingdom . | |

OTHER PUBLICATIONS

Hardjipanayis et al, "Cobalt Free Permanent Magnet Materials Based on Iron Rare Earth Alloys" J. Appl. Phys. 55(6), Mar. 15, 1985, pp. 2073 to 2077.

Endoh et al, "Magnetic Properties and Thermal Stability of Ga Substituted Nd-Fe-Co-B Magnets," IEEE Trans. on Magnetics, vol. MAG 23, No. 5, Sep. 1987 p. 1190-1192.

Verified Translation of JP-A-62-136,511 Jun. 19, 1987.

M. Sagawa et al, J. Appl. Phys. 55 (6) 2083 (1984).

T. Mizoguchi et al., Appl. Phys. Lett. 48, 1309 (1986).

*Primary Examiner*—John P. Sheehan

*Attorney, Agent, or Firm*—Finnegan, Henderson, Farabow, Garrett & Dunner

[57] ABSTRACT

A permanent magnet having good thermal stability, consisting essentially of the composition represented by the general formula:

$$R[Fe_{1-x-y-z}Co_xB_yGa_z]_A$$

wherein R is Nd alone or one or more rare earth elements mainly composed of Nd, Pr or Ce, $0 \leqq x \leqq 0.7$, $0.02 \leqq y \leqq 0.3$, $0.001 \leqq z \leqq 0.15$ and $4.0 \leqq A \leqq 7.5$.

This permanent magnet may contain one or more additional elements selected from Nb, W, V, Ta and Mo. This permanent magnet has high coercive force and Curie temperature and thus highly improved thermal stability.

6 Claims, 8 Drawing Sheets

PERMANENT MAGNET WITH GOOD THERMAL STABILITY

This is a division of application Ser. No. 07/298,850, filed Jan. 19, 1989, now abandoned, which is a continuation of Ser. No. 07/072,045, filed Jul. 10, 1987, now abandoned.

BACKGROUND OF THE INVENTION

The present invention relates to rare earth permanent magnet materials, particularly to R-Fe-B permanent magnet materials having good thermal stability.

R-Fe-B permanent magnet materials have been developed as new compositions having higher magnetic properties than R-Co permanent magnet materials (Japanese Patent Laid-Open Nos. 59-46008, 59-64733 and 59-89401, and M. Sagawa et al, "New Material for Permanent Magnets on a Basis of Nd and Fe," J. Appl. Phys. 55[6] 2083(1984)). According to these references, an alloy of $Nd_{15}Fe_{77}B_8[Nd(Fe_{0.91}B_{0.09})_{5.67}]$, for instance, has such magnetic properties as (BH)max of nearly 35MGOe and iHc of nearly 10KOe. The R-Fe-B magnets, however, have low Curie temperatures, so that they are poor in thermal stability. To solve these problems, attempts were made to elevate Curie temperature by adding Co (Japanese Patent Laid-Open No. 59-64733). Specifically, the R-Fe-B permanent magent has Curie temperature of about 300° C. and at highest 370° C. (Japanese Patent Laid-Open No. 59-46008), while the substitution of Co for part of Fe in the R-Fe-B magnet serves to increase the Curie temperature to 400°-800° C. (Japanese Patent Laid-Open No. 59-64733). However the addition of Co decreases the coercive force iHc of the R-Fe-B magnet.

Attempts were also made to improve the coercive force by adding Al, Ti, V, Cr, Mn, Zn, Hf, Nb, Ta Mo, Ge, Sb, Sn, Bi, Ni, etc. It was pointed out that Al is particularly effective to improve the coercive force (Japanese Patent Laid-Open No. 59-89401). However, since these elements are non-magnetic except for Ni, the addition of larger amounts of such elements would result in the decrease in residual magnetic flux density Br, which in turn leads to the decrease in (BH)max.

Further, the substitution of heavy rare earth elements such as Tb, Dy and Ho for part of Nd was proposed to improve coercive force while retaining high (BH) max (Japanese Patent Laid-Open Nos. 60-32306 and 60-34005). By substituting the heavy rare earth element for part of Nd, the coercive force is enhanced from 9KOe or so to 12-18KOe for (BH)max of about 30MGOe. However, since heavy rare earth elements are very expensive, the substitution of such heavy rare earth elements for part of neodymium in large amounts undesirably increases the costs of the R-Fe-B magnets.

In addition, the addition of both Co and Al was proposed to improve thermal stability of the R-Fe-B magnet (T. Mizoguchi et al., Appl. Phys. Lett. 48, 1309 (1986)). The substitution of Co for part of Fe increases Curie temperature Tc, but it acts to lower iHc, presumably because there appear ferromagnetic precipitation phases of Nd (Fe, Co)$_2$ on the grain boundaries, which form nucleation sites of reverse domains. The addition of Al in combination with Co serves to form non-magnetic $Nd(Fe,Co,Al)_2$ phases which suppress the generation of the nucleation sites of reverse magnetic domains. However, since the addition of Al greatly decreases Curie temperature RTc, R-Fe-B magnets containing Co and Al inevitably have poor thermal stability at as high temperatures as 100° C. or more. In addition, the coercive force iHc of such magnets is merely 9KOe or so.

OBJECT AND SUMMARY OF THE INVENTION

An object of the present invention is, therefore, to provide an R-Fe-B permanent magnet with raised Curie temperature and sufficient coercive force and thus improved thermal stability.

As a result of intense research in view of the above object, the inventors have found that the addition of Ga or Co and Ga in combination provides R-Fe-B magnets with higher Curie temperature, sufficient coercive force and thus higher thermal stability with cost advantages.

That is, the permanent magnet having good thermal stability according to the present invention consists essentially of a composition represented by the general formula:

$$R(Fe_{l-x-y-z}Co_xB_yGa_z)_Z$$

wherein R is Nd alone or one or more rare earth elements mainly composed of Nd, Pr or Ce, $0 \leqq x \leqq 0.7$, $0.02 \leqq y \leqq 0.3$, $0.001 \leqq z \leqq 0.15$, and $4.0 \leqq A \leqq 7.5$.

DETAILED DESCRIPTION OF THE INVENTION

Figure 1:
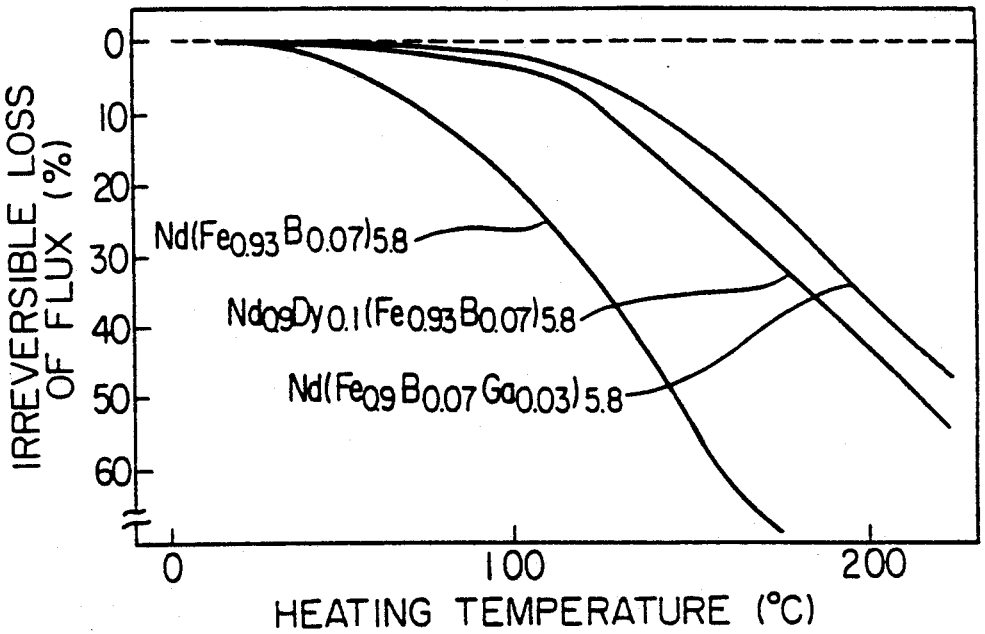
FIG. 1 is a graph showing the variations of irreversible losses of flux of Nd-Fe-B, Nd-Dy-Fe-B and nd-Fe-B-Ga magnets with heating temperatures.

The reasons for limiting the composition ranges of components in the magnet alloy of the present invention will be described below.

When Co is added to the R-Fe-B magnet, its Curie temperature is raised, but its crystal magnetic anisotropy constant is decreased, resulting in the decrease in coercive force. However, the addition of Co and Ga in combination provides the magnet With higher Curie temperature and thus higher coercive force. Although the addition of such elements as Al and Si to an R-Fe-Co-B magnet may lead to improved coercive force, the maximum improvement in coercive force can be obtained by the addition of Ga. And although heavy rare earth elements such as Tb, Dy and Ho are usually added to improve coercive force, the use of Ga can minimize the use of expensive heavy rare earth elements, if any. Thus the disadvantage of the R-Fe-B magnet that it has a low Curie temperature which leads to poor thermal stability can be overcome by the addition of Ga or Co and Ga in combination, providing the magnet with higher coercive force and higher Curie temperature and thus better thermal stability and cost advantages.

The amount of Co represented by "x" is 0–0.7. When it exceeds 0.7, the residual magnetic flux density Br of the resulting magnet becomes too low. To sufficiently improve the Curie temperature Tc, the lower limit of Co is preferably 0.01, and to have a well-balanced combination of such magnetic properties as iHc and Br and Tc, the upper limit of Co is preferably 0.4. The most preferred amount of Co is 0.05–0.25.

The addition of Ga leads to remarkable improvement of coercive force. This improvement appears to be provided by increasing the Curie temperature of a BCC phase in the magnet. The BCC phase is a polycrystalline phase having a body-centered cubic crystal structure surrounding in a width of 100–5000Å a main phase of the Nd-Fe-B magnet ($Nd_2Fe_{14}B$). This BCC phase is in turn surrounded by a Nd-rich phase (Nd: 70–95 at. % and balance Fe). The Curie temperature of this BCC phase corresponds to a temperature at which the coercive force of the magnet becomes lower than 50 Oe, greatly affecting the temperature characteristics of the magnet. The addition of Ga serves to raise the Curie temperature of the BCC phase, effective for improving the temperature characteristics.

The amount of Ga represented by "z" is 0.001–0.15. When it is less than 0.001, substantially no effect is obtained on improving the Curie temperature of the magnet. On the other hand, when "z" exceeds 0.15, extreme decrease in saturation magnetization and Curie temperature ensues, providing undesirable permanent magnet materials. The preferred amount of Ga is 0.002–0.10, and the most preferred amount of Ga is 0.005–0.05.

When the amount of boron represented by "y" is less than 0.02, Curie temperature is low and high coercive force cannot be obtained. On the other hand, when the amount of B "y" is higher than 0.3, the saturation magnetization are decreased, forming phases undesirable to magnetic properties. Accordingly, the amount of B should be 0.02–0.3. The preferred range of "y" is 0.03–0.20. The most preferred amount of B is 0.04–0.15.

When "A" is less than 4, the saturation magnetization is low, and when it exceeds 7.5, phases rich in Fe and Co appear, resulting in extreme decrease in coercive force, Accordingly, "A" should be 4.0–7.5. The preferred range of "A" is 4.5–7.0. The most preferred range of A is 5.0–6.8.

The permanent magnet of the present invention may further contain an additional element generally represented by "M" in the following formula:

$$R(Fe_{1-x-y-z-u}Co_xB_yGa_zM_u)_A$$

wherein R is Nd alone or one or more rare earth elements mainly composed of Nd, Pr or Ce, part of which may be substituted by Dy, Tb or Ho, M is one or more elements selected from Nb, W, V, Ta and Mo, $0 \leqq x \leqq 0.7$, $0.02 \leqq y \leqq 0.3$, $0.001 \leqq z \leqq 0.15$, $0.001 \leqq u \leqq 0.1$, and $4.0 \leqq A \leqq 7.5$.

Nb, W, V, Ta or Mo is added to prevent the grain growth. The amount of these elements represented by "u" is 0.001–0.1. When it is less than 0.001, sufficient effects cannot be obtained, and when it exceeds 0.1, the saturation magnetization is extremely decreased, providing undesirable permanent magnets.

The addition of Nb does not decrease Br as much as the addition of Ga does, while it slightly increases iHc. Nb is effective for increasing corrosion resistance, and so in the case of highly heat-resistant alloys likely to be exposed to relatively high temperatures, it is a highly effective additive. When the amount of Nb represented by u is less than 0.001, sufficient effects of increasing iHc cannot be achieved, neither does the magnet alloy have sufficiently high corrosion resistance. On the other hand, when the amount of Nb exceeds 0.1, undesirably large decrease in Br and Curie temperature ensues. The preferred range of Nb is $0.002 \leqq z \leqq 0\ 04$.

The addition of tungsten (W) serves to extremely improve the temperature characteristics. When the amount of W("u") exceeds 0.1, the saturation magnetization and the coercive force are extremely decreased. And when "u" is less than 0.001, sufficient effects cannot be obtained. The preferred amount of W is 0.002–0.04.

With respect to the rare earth element "R," it may be Nd alone, or a combination of Nd and a light rare earth element such as Pr or Ce, or Pr plus Ce. When Pr and/or Ce are contained, the proportion of Pr to Nd may be 0:1–1:0, and that of Ce to Nd may be 0:1–0.3:0.7.

Nd may also be substituted by Oy which acts to somewhat raise Curie temperature and enhance coercive force iHc. Thus, the addition of Dy is effective to improve the thermal stability of the permanent magnet of the present invention. However, an excess amount of Dy leads to the decrease in residual magnetic flux density Br. Accordingly, the proportion of Dy to Nd should be 0.03:0.97–0.4:0.6 by atomic ratio. The preferred atomic ratio of Dy with respect to Nd 0.05–0.25

.

The permanent magnet of the present invention can be produced by a powder metallurgy method, a rapid quenching method or a resin bonding method. These methods will be explained below.

(1) Powder Metallurgy Method

A magnet alloy is obtained by arc melting or high-frequency melting. The purity of starting materials may be 90% or more for R, 95% or more for Fe, 95% or more for Co, 90% or more for B, 95% or more for Ga and 95% or more for M(Nb, W, V, Ta, Mo), if any. A starting material for B may be ferroboron and a starting material for Ga may be ferrogallium. Further, a starting material for M(Nb, W, V, Ta, Mo) may be ferroniobium, ferrotungsten, ferrovanadium, ferrotantalum or ferromolybdenum. Since the ferroboron and the ferrogallium contain inevitable impurities such as Al and Si, high coercive force can be obtained by synergistic effect of such elements as Ga, Al and Si.

Pulverization may be composed of the steps of pulverization and milling. The pulverization may be carried out by a stamp mill, a jaw crusher, a brown mill, a disc mill, etc., and the milling may be carried out by a jet mill, a vibration mill, a ball mill, etc. In any case, the pulverization is preferably carried out in a non-oxidizing atmosphere to prevent the oxidation of the alloy. The final particle size is desirably 2–5 μm as measured by the Fischer Subsieve Sizer (hereinafter "FSSS").

The resulting fine powers are pressed in a magnetic field by a die. This is indispensable for providing the alloy with anisotropy that the magnet powders to be pressed have C axes aligned in the same direction, Sintering is carried out in an inert gas such as Ar, He, etc., or in vacuum, or in hydrogen at 1050°–1150° C. Heat treatment is carried out on the sintered magnet alloy at 400°–1000° C.

(2) Rapid Quenching

A magnet alloy is prepared in the same manner as in the powder metallurgy method (1). A melt of the resulting alloy is rapidly quenched by a single-roll or double-roll quenching apparatus. That is, the alloy melted, for instance, by high frequency is ejected through a nozzle onto a roll rotating at a high speed, thereby rapidly quenching it. The resulting flaky products are heat-treated at 500°–800° C. Materials provided by this rapid quenching method may be used for three kinds of permanent magnets.

(a) The resulting flaky products are pulverized to 10–500 μm in particle size by a disc mill, etc. The powders are mixed, for instance, with an epoxy resin for die molding, or with a nylon resin for injection molding. To improve the adhesion of the alloy powders with resins, proper coupling agents may be applied to the alloy powders before blending. The resulting magnets are isotropic ones.

(b) The flaky products are pressed by a hot press or a hot isostatic press (HIP), to provide bulky, isotropic magnets. The magnets thus prepared are isotropic ones.

(c) The bulky, isotropic magnets obtained in the above (b) are made flat by upsetting. This plastic deformation provides the magnets with anisotropy that their C axes are aligned in the same direction. The magnets thus prepared are anisotropic ones.

(3) Resin Bonding Method

The starting material may be an R-Fe-Co-B-Ga alloy obtained in the above (1), sintered bodies obtained by pulverization and sintering of the above alloy, rapidly quenched flakes obtained in the above (2), or bulky products obtained by hot-pressing or upsetting the flakes. These bulky products are pulverized to 30–500μm in particle size by a jaw crusher, a brown mill, a disc mill, etc. The resulting fine powders are mixed with resins and formed by die molding or injection molding. The application of a magnetic field during the molding operation provides anisotropic magnets in which their C axes are aligned in the same direction.

The present invention will be described in further detail by the following Examples.

In the Examples, starting materials used were 99.9%-pure Nd, 99.9%-pure Fe, 99.9%-pure Co, 99.5%-pure B, 99.9999%-pure Ga, 99.9%-pure Nb and 99.9%-pure W, and all other elements used were as pure as 99.9% or more.

EXAMPLE 1

Various alloys represented by the composition of $Nd(Fe_{0.70}Co_{0.2}B_{0.07}M_{0.03})_{6.5}$(M=B, Al, Si, P, T, V, Cr, Mn, Ni, Cu, Ga, Ge, Zr, Nb, Mo, Ag, In, Sb, W) were prepared by arc melting. The resulting ingots were coarsely pulverized by a stamp mill and a disc mill, and after sieving to finer than 32 mesh milling was carried out by a jet mill. A pulverization medium was an $N_2$ gas, and fine powders of 3.5μm in particle size (FSSS) were obtained. The resulting powders were pressed in a magnetic field of 15KOe whose direction was perpendicular to the pressing direction. Press pressure was 2t/cm$^2$. The resulting green bodies were sintered in vacuum at 1090° C. for two hours. Heat treatment was carried out at 500°–900° C. for one hour, followed by quenching. The results are shown in Table 1.

TABLE 1

Magnetic Properties of $Nd(Fe_{0.7}Co_{0.2}B_{0.07}M_{0.03})_{6.5}$ Magnet

| M | B | Al | Si | P | Ti | V | Cr | Mn | Ni | Cu |
|---|---|---|---|---|---|---|---|---|---|---|
| 4πIs(KG) | 13.31 | 12.61 | 12.80 | 12.90 | 12.77 | 13.19 | 12.30 | 12.50 | 12.95 | 12.57 |
| 4πIr(KG) | 12.80 | 12.45 | 12.65 | 0 | 11.80 | 13.05 | 12.15 | 12.34 | 12.78 | 12.32 |
| iHc(KOe) | 2.6 | 8.5 | 7.0 | 0 | 4.8 | 4.9 | 5.1 | 5.3 | 4.1 | 3.0 |
| (BH)max(MGOe) | 13 | 33.5 | 32.0 | 0 | 24.0 | 25.5 | 28.0 | 24.0 | 13.1 | 18.1 |
| Tc(°C.) | 477 | 460 | 458 | 482 | 467 | 470 | 478 | 431 | 485 | 481 |

| M | Ga | Ge | Zr | Nb | Mo | Ag | In | Sb | W |
|---|---|---|---|---|---|---|---|---|---|
| 4πIs(KG) | 12.60 | 12.72 | 12.30 | 13.03 | 13.10 | 13.22 | 12.70 | 12.05 | 12.95 |
| 4πIr(KG) | 12.50 | * | 10.5 | 12.9 | * | * | * | * | 12.75 |
| iHc(KOe) | 16.0 | * | 4.3 | 6.9 | * | * | * | * | 6.0 |
| (BH)max(MGOe) | 35.0 | * | 12.1 | 35.1 | * | * | * | * | 32.2 |
| Tc(°C.) | 468 | 479 | 466 | 477 | 465 | 483 | 488 | 482 | 476 |

Note
Tc: Curie temperature
*Nearly 0

Among 19 elements "M" examined, only Ga provided iHc exceeding 10KOe. This shows that Ga is extremely effective for improving the coercive force. Incidentally, though the coercive force is also increased by the addition of Al, it is as low as 8.5KOe.

EXAMPLE 2 pulverization, milling, sintering and heat treatment were carried out in the same manner as in Example 1 on alloys having the compositions:

$Nd(Fe_{0.9-x}Co_xB_{0.07}Ga_{0.03})_{5.8}$(x=0, 0.05, 0.1, 0.15, 0.2, 0.25);

$Nd(Fe_{0.93-x}Co_xB_{0.07})_{5.8}$(x=0, 0.05, 0.1, 0.15, 0.2, 0.25); and $Nd_{0.9}Dy_{0.1}(Fe_{0.93-x}co_xB_{0.07})_{5.8}$ (x=0, 0.05, 0.1, 0.15, 0.2, 0.25).

The resulting magnets were measured with respect to magnetic properties. The results are shown in Tables 2, 3 and

TABLE 2

Magnetic Properties of $Nd(Fe_{0.9-x}Co_xB_{0.07}Ga_{0.03})_{5.8}$ Magnets

| Magnetic Properties | X = 0 | 0.05 | 0.1 | 0.15 | 0.2 | 0.25 |
|---|---|---|---|---|---|---|
| $4\pi Ir$(KG) | 12.6 | 12.55 | 12.43 | 12.31 | 12.2 | 12.09 |
| iHc(KOe) | 20.6 | 19.6 | 18.3 | 17.9 | 17.8 | 16.5 |
| (BH)max(MGOe) | 37.0 | 36.2 | 35.6 | 35.1 | 34.3 | 33.2 |

TABLE 3

Magnetic Properties of $Nd(Fe_{0.93-x}Co_xB_{0.07})_{6.5}$ Magnets

| Magnetic Properties | X = 0 | 0.05 | 0.1 | 0.15 | 0.2 | 0.25 |
|---|---|---|---|---|---|---|
| $4\pi Ir$(KG) | 13.4 | 13.32 | 13.21 | 13.09 | 13.0 | 12.88 |
| iHc(KOe) | 9.0 | 8.8 | 8.3 | 8.0 | 7.5 | 7.1 |
| (BH)max(MGOe) | 42.1 | 41.5 | 41.1 | 40.8 | 39.7 | 38.8 |

TABLE 4

Magnetic Properties of $Nd_{0.9}Dy_{0.1}(Fe_{0.93-x}Co_xB_{0.07})_{5.8}$ Magnets

| Magnetic Properties | X = 0 | 0.05 | 0.1 | 0.15 | 0.2 | 0.25 |
|---|---|---|---|---|---|---|
| $4\pi Ir$(KG) | 12.62 | 12.51 | 12.38 | 12.31 | 12.19 | 12.11 |
| iHc(KOe) | 15.6 | 15.0 | 14.1 | 13.4 | 12.3 | 11.6 |
| (BH)max(MGOe) | 38.2 | 37.5 | 36.2 | 35.8 | 35.0 | 34.3 |

Figure 2:
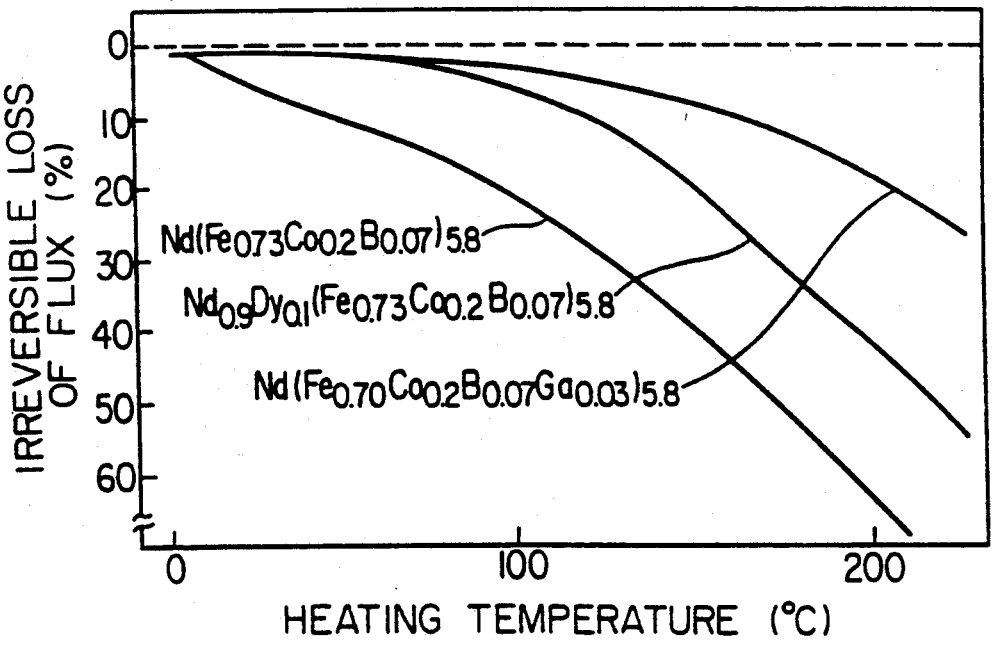
FIG. 2 is a graph showing the variations of irreversible losses of flux of Nd-Fe-Co-B, Nd-Dy-Fe-Co-B and Nd-Fe-Co-B-Ga magnets with heating temperatures.

And the samples in which the amount of Co was 0 and 0.2, respectively were heated at various temperatures for 30 minutes, and then measured with respect to the change of open fluxes (irreversible loss of flux) to know their thermal stability. The samples tested were those worked to have a permeance coefficiant (Pc) of −2. The samples were magnetized at a magnetic field strength of 25KOe, and their magnetic fluxes were first measured at 25° C. The samples were heated to 80° C. and then cooled down to 25° C. to measure the magnetic fluxes again. Thus, the irreversible loss of flux at 80° C. was determined. By elevating the heating temperature to 200° C. stepwise by 20° C., the irreversible loss of flux at each temperature was obtained in the same manner. The results are shown in FIGS. 1 and 2. It is clear that the addition of Ga enhances the coercive force of the magnets, thus extremely improving their thermal stability.

EXAMPLE 3

Pulverization, milling, sintering and heat treatment were carried out in the same manner as in Example 1 on magnet alloys having the compositions of $Nd(Fe_{0.7}Co_{0.2}B_{0.08}Ga_{0.02})_A$ (A=5.6, 5.8, 6.0, 6.2, 6.4, 6.6), and $Nd(Fe_{92}B_{0.08})_A$ (A=5.6, 5.8, 6.0, 6.2, 6.4, 6.6).

The magnets thus prepared were measured with respect to magnetic properties. The results are shown in Tables 5 and 6.

TABLE 5

Magnetic properties of $Nd(Fe_{0.7}Co_{0.2}B_{0.08}Ga_{0.02})_A$ Magnets

| Magnetic Properties | A = 5.6 | 5.8 | 6.0 | 6.2 | 6.4 | 6.6 |
|---|---|---|---|---|---|---|
| $4\pi Ir$(KG) | 12.25 | 12.32 | 12.39 | 12.48 | 12.56 | 12.7 |
| iHc(KOe) | 15.4 | 15.1 | 15.6 | 14.2 | 13.1 | 12.0 |
| (BH)max(MGOe) | 35.8 | 36.1 | 36.0 | 36.5 | 36.9 | 37.1 |

TABLE 6

Magnetic properties of $Nd(Fe_{0.92}B_{0.08})_A$ Magnets

| Magnetic Properties | A = 5.6 | 5.8 | 6.0 | 6.2 | 6.4 | 6.6 |
|---|---|---|---|---|---|---|
| $4\pi Ir$(KG) | 13.04 | 13.2 | 13.4 | 13.6 | 13.7 | 13.8 |
| iHc(KOe) | 10.0 | 9.3 | 9.0 | 0 | 0 | 0 |
| (BH)max(MGOe) | 40.2 | 41.3 | 42.6 | 0 | 0 | 0 |

For the Nd-Fe-B ternary alloy, iHc, (BH)max were almost 0 when A=6.2 or more. But the addition of both Co and Ga provided high coercive force even when A was 6.6, thereby providing high magnetic properties. It may be theorized that in the Nd-Fe-B ternary alloy, when A is 6.2 or more, an Nd-rich phase serving as a liquid phase in the process of sintering is reduced by the oxidation of Nd, so that high coercive force cannot be obtained. On the other hand, when both Co and Ga are added, Ga works as a liquid phase in place of Nd which is prove to be oxidized, thereby providing high coercive force.

EXAMPLE 4

Alloys of the compositions: $Nd(Fe_{0.892}Co_{0.1}B_{0.07}Ga_{0.01})_{6.5}$ and $Nd(Fe_{0.93}B_{0.07})_{6.5}$ were prepared by arc melting. The resulting alloys were rapidly quenched from their melts by a single roll method. The resulting flaky materials were heat-treated at 700° C. for 1 hour. The samples thus prepared were pulverized to about 100 μm by a disc mill. The resulting coarse powders of each composition were separated into two groups; (a) one was blended with an epoxy resin and molded by a die, and (b) the other was hot-pressed. The magnetic properties of each of the resulting magnets are shown in Table 7.

TABLE 7

Magnetic Properties of Magnets Prepared by Rapid Quenching Method

| Magnetic Properties | $Nd(Fe_{0.82}Co_{0.1}B_{0.07}Ga_{0.01})_{6.5}$ (a) | (b) | $Nd(Fe_{0.93}B_{0.07})_{6.5}$ (a) | (b) |
|---|---|---|---|---|
| $4\pi Ir$(KG) | 6.1 | 8.4 | 6.5 | 8.8 |
| iHc(KOe) | 21.6 | 20.1 | 14.6 | 12.3 |
| (BH)max(MGOe) | 7.1 | 13.2 | 7.3 | 13.6 |
| Irreversible Loss of Flux* | 1.3 | 1.8 | 4.3 | 5.1 |

Note
*Irreversible loss of flux after heating at 100° C. for 0.5 hour (Pc = −2)
(a) Bonded magnet
(b) Hot-pressed magnet As is clear from the above data, when both Co and Ga were added, the iHc was as high as 20KOe or more, thus providing magnets with good thermal stability.

EXAMPLE 5

An alloy having the composition: $Nd(Fe_{0.82}Co_{0.1}B_{0.07}Ga_{0.01})_{5.4}$ was prepared by arc melting. The resulting alloy was rapidly quenched from its melt by a single roll method. The sample was compressed by HIP, and made flat by upsetting. The resulting magnet had the following magnetic properties: $4\pi Ir$=11.8KG, iHc=13.0KOe, and (BH)max=32.3MGOe.

EXAMPLE 6

Alloys having the compositions: $Nd(Fe_{0.82}Co_{0.1}B_{0.07}Ga_{0.01})_{5.4}$ and $Nd(Fe_{0.92}B_{0.08})_{5.4}$ were prepared by arc melting. The resulting alloys were processed in two ways: (a) one was pulverized to 50 μm or less, and (b) the other was rapidly quenched from its melt by a single roll method, and the resulting flaky product was subjected to hot isotropic pressing (HIP) and made flat by upsetting, and thereafter pulverized to 50 μm or less. These powders were blended with an epoxy resin and formed into magnets in a magnetic field. The resulting magnets had magnetic properties shown in table 8. it is noted that the Nd-Fe-B ternary alloy had extremely low coercive force, while the magnet containing both Co and Ga had sufficient coercive force.

TABLE 8

| Magnetic Properties of Bonded Magnets | | | | |
|---|---|---|---|---|
| Magnetic | $Nd(Fe_{0.82}Co_{0.1}B_{0.07}Ga_{0.01})_{5.4}$ | | $Nd(Fe_{0.92}B_{0.08})_{5.4}$ | |
| Properties | (a) | (b) | (a) | (b) |
| 4πIr(KG) | 8.2 | 9.3 | 8.6 | 9.6 |
| iHc(KOe) | 5.0 | 7.6 | 0.8 | 2.3 |
| (BH)max(MGOe) | 13 | 18 | 3 | 10 |

Note:
(a) Ingot → Pulverization → Resin blending
(b) Ingot → Rapid quenching → HIP → Upsetting → Pulverization → Resin blending

EXAMPLE 7

An alloy having the composition of $(Nd_{0.8}Dy_{0.2})(Fe_{0.835}Co_{0.06}B_{0.08}Nb_{0.015}Ga_{0.01})_{5.5}$ was formed into an ingot by high-frequency melting. The resulting alloy ingot was coarsely pulverized by a stamp mill and a disc mill, and then finely pulverized in a nitrogen gas as a pulverization medium to provide fine powders of 3.5 -μm particle size (FSSS). The fine powders were pressed in a magnetic field of 15KOe perpendicular to the compressing direction. The compression pressure was 2 tons/cm$^2$. The resulting green bodies were sintered at 1100° C. for 2 hours in vacuo, and then cooled to room temperature in a furnace. A number of the resulting sintered alloys were heated at 900° C. for 2 hours and then slowly cooled at 1.5° C./min. to room temperature.

After cooling, the annealing was conducted at various temperatures between 540° C. and 640° C. Magnetic properties were measured on the heat-treated magnets. The results are shown in Table 9.

TABLE 9

| Annealing Temp. (°C.) | Br(G) | bHc(Oe) | iHc(Oe) | (BH)max(MGOe) |
|---|---|---|---|---|
| 540 | 10400 | 10000 | 26500 | 26.0 |
| 560 | 10450 | 10010 | 26500 | 26.2 |
| 580 | 10400 | 10000 | 26400 | 26.0 |
| 600 | 10450 | 10100 | 26400 | 26.4 |
| 620 | 10400 | 10100 | 26200 | 26.0 |
| 640 | 10400 | 10100 | 25200 | 26.1 |

After thermal demagnetization of these magnets, they were worked to have a permeance coefficient Pc=−2 and magnetized again at 25 KOe. They were further heated at every 20° C. between 180° C. and 280° C. for one hour. The irreversible loss of flux at each heating temperature was measured. The results are shown in Table 10.

TABLE 10

| Annealing | Irreversible Loss of Flux (%, Pc = −2) | | | | | |
|---|---|---|---|---|---|---|
| Temp. (°C.) | 180 | 200 | 220 | 240 | 260 | 280 |
| 540 | 0.8 | 1.0 | 1.3 | 1.9 | 4.0 | 25.0 |
| 560 | 0.8 | 1.0 | 1.2 | 1.8 | 3.8 | 22.5 |
| 580 | 0.9 | 1.1 | 1.3 | 1.8 | 3.2 | 21.6 |
| 600 | 0.9 | 1.1 | 1.2 | 2.0 | 4.2 | 19.3 |
| 620 | 0.9 | 1.1 | 1.2 | 1.8 | 7.6 | 22.0 |

TABLE 10-continued

| Annealing | Irreversible Loss of Flux (%, Pc = −2) | | | | | |
|---|---|---|---|---|---|---|
| Temp. (°C.) | 180 | 200 | 220 | 240 | 260 | 280 |
| 640 | 0.8 | 1.0 | 1.2 | 2.2 | 4.3 | 25.4 |

It is shown from Table 10 that the irreversible loss of flux is 5% or less even with heating at 260° C., meaning that the magnets have good thermal stability.

For the purpose of comparison, an alloy of $(Nd_{0.8}Dy_{0.2})(Fe_{0.86}Co_{0.06}B_{0.08})_{5.5}$ was prepared in the same manner as above. The annealing temperature was 600° C. The magnetic properties of the resulting magnet were as follows: Br of nearly 11200G, bHc of nearly 10700 Oe, iHc of nearly 24000 Oe and (BH)max of nearly 29.8 MGOe. The irreversible loss of flux by heating was 1.0% for 180° C. heating, 1.8% for 200° C. heating, 5.7% for 220° C. heating and 23.0% for 240° C. heating, when Pc=−2.

Thus it is clear that the addition of both Nb and Ga increases the heat resistance by about 40° C.

EXAMPLE 8

Three types of alloys represented by the formulae:

$(Nd_{0.8}Dy_{0.2})(Fe_{0.92-X}Co_XB_{0.08})_{5.5}$, wherein X=0.06–0.12, $(Nd_{0.8}Dy_{0.2})(Fe_{0.905-X}Co_XB_{0.08}Nb_{0.015})_{5.5}$, wherein X=0.06–0.12, and $(Nd_{0.8}Dy_{0.2})(Fe_{0.0895-X}Co_XB_{0.08}Nb_{0.015}Ga_{0.01})_{5.5}$, wherein X=0.06–0.12 were melted, pulverized and formed in the same manner as in Example 7.

Each of the resulting green bodies was sintered in vacuum at 1090° C. for 1 hour, and then heat-treated at 900° C. for hours, and thereafter cooled down to room temperature at a rate of 1° C./min. It was again heated for annealing in an Ar gas flow at 600° C. for 1 hour and rapidly cooled in water. Magnetic properties were measured on each sample. The results are shown in Tables 11(a)–(c).

TABLE 11(a)

| $(Nd_{0.8}Dy_{0.2})(Fe_{0.92-x}Co_xB_{0.08})_{5.5}$ | | | | |
|---|---|---|---|---|
| x | Br(G) | bHc(Oe) | iHc(Oe) | (BH)max(MGOe) |
| 0.06 | 11000 | 10500 | 24000 | 30.0 |
| 0.08 | 11050 | 10500 | 20000 | 30.1 |
| 0.10 | 11050 | 10450 | 17000 | 30.5 |
| 0.12 | 11000 | 10500 | 15000 | 30.0 |

TABLE 11(b)

| $(Nd_{0.8}Dy_{0.2})(Fe_{0.905-x}Co_xB_{0.08}Nb_{0.015})_{5.5}$ | | | | |
|---|---|---|---|---|
| x | Br(G) | bHc(Oe) | iHc(Oe) | (BH)max(MGOe) |
| 0.06 | 10800 | 10400 | 22400 | 28.0 |
| 0.08 | 10900 | 10500 | 18200 | 28.8 |
| 0.10 | 10800 | 10400 | 16000 | 28.0 |
| 0.12 | 10900 | 10400 | 15100 | 28.2 |

TABLE 11(c)

| $(Nd_{0.8}Dy_{0.2})(Fe_{0.895-x}Co_xB_{0.08}Nb_{0.015}Ga_{0.01})_{5.5}$ | | | | |
|---|---|---|---|---|
| x | Br(G) | bHc(Oe) | iHc(Oe) | (BH)max(MGOe) |
| 0.06 | 10450 | 10100 | 26400 | 26.4 |
| 0.08 | 10500 | 10200 | 25300 | 26.6 |
| 0.10 | 10550 | 10200 | 24000 | 26.7 |
| 0.12 | 10500 | 10200 | 22700 | 26.7 |

The irreversible loss of flux by heating is also shown in Tables 12(a)–(c). In any of these three types of alloys, the increase in the Co content leads to the decrease in iHc without substantially changing (BH)max. The irreversible loss of flux becomes larger with the increase in the Co content. When the amount of Co is 0.06, the highest heat resistance can be provided. The comparison of these three types of alloys shows that those containing both Ga and Nb have the highest heat resistance.

TABLE 12(a)

| | $(Nd_{0.8}Dy_{0.2})(Fe_{0.92-x}Co_xB_{0.08})_{5.5}$ Irreversible Loss of Flux (%, Pc = −2) | | |
|---|---|---|---|
| x | 160° C. | 200° C. | 220° C. |
| 0.06 | 0.12 | 3.3 | 9.6 |
| 0.08 | 0.08 | 3.9 | 10.3 |
| 0.10 | 8.2 | 28.5 | 35.5 |
| 0.12 | 9.5 | 30.1 | 37.1 |

TABLE 12(b)

| | $(Nd_{0.8}Dy_{0.2})(Fe_{0.905-x}Co_xB_{0.08}Nb_{0.015})_{5.5}$ Irreversible Loss of Flux (%, Pc = −2) | | | |
|---|---|---|---|---|
| x | 160° C. | 200° C. | 240° C. | 260° C. |
| 0.06 | 0.74 | 0.96 | 9.5 | 26.3 |
| 0.08 | 0.75 | 9.5 | 18.8 | 35.5 |
| 0.10 | 2.3 | 19.3 | 44.6 | 59.8 |
| 0.12 | 3.5 | 26.1 | 51.6 | 61.5 |

TABLE 12(c)

| | $(Nd_{0.8}Dy_{0.2})(Fe_{0.895-x}Co_xB_{0.08}Nb_{0.015}Ga_{0.01})_{5.5}$ Irreversible Loss of Flux (%, Pc = −2) | | | | |
|---|---|---|---|---|---|
| x | 180° C. | 200° C. | 240° C. | 260° C. | 280° C. |
| 0.06 | 0.94 | 1.1 | 2.0 | 4.2 | 19.3 |
| 0.08 | 0.76 | 0.97 | 1.7 | 8.0 | 21.6 |
| 0.10 | 0.74 | 0.92 | 1.6 | 5.2 | 18.7 |
| 0.12 | 0.70 | 0.94 | 3.4 | 12.4 | 24.4 |

EXAMPLE 9

Various alloys represented by the formula: $(Nd_{0.8}Dy_{0.2})(Fe_{0.86-u}Co_{0.06}B_{0.08}Nb_u)_{5.5}$ wherein u=0–0.05 were melted, pulverized and formed in the same manner as in Example 7. The resulting green bodies were sintered at 1080° C. for 2 hours in vacuum. The resulting sintered bodies were again heated at 900° C. for 2 hours and cooled down to room temperature at a cooling rate of 2° C./min. They were further heated for annealing in an Ar flow at 600° C. for 0.5 hour and rapidly cooled in water. Magnetic properties were measured on each sample. The results are shown in Table 13.

TABLE 13

| | $(Nd_{0.8}Dy_{0.2})(Fe_{0.86-u}Co_{0.06}B_{0.08}Nb_u)_{5.5}$ | | | |
|---|---|---|---|---|
| u | Br(G) | bHc(Oe) | iHc(Oe) | (BH)max(MGOe) |
| 0 | 11050 | 10700 | 22500 | 29.5 |
| 0.003 | 11050 | 10700 | 23100 | 29.2 |
| 0.006 | 11050 | 10600 | 23800 | 29.0 |
| 0.009 | 10850 | 10500 | 24300 | 28.2 |
| 0.012 | 10850 | 10500 | 24700 | 28.4 |
| 0.015 | 10850 | 10500 | 25000 | 28.3 |
| 0.020 | 10700 | 10400 | 26200 | 27.4 |
| 0.030 | 10500 | 10000 | 28000 | 26.1 |
| 0.040 | 10300 | 9900 | >28000 | 25.3 |
| 0.050 | 10150 | 9700 | >28000 | 24.0 |

It is apparent that the addition of Nb decreases Br and (BH)max while it increases iHc. As is shown in Table 14, the irreversible loss of flux by heating at 220° C. decreases with the increase in iHc.

TABLE 14

| | $(Nd_{0.8}Dy_{0.2})(Fe_{0.86-u}Co_{0.06}B_{0.08}Nb_u)_{5.5}$ Irreversible Loss of Flux by Heating at 220° C. (%, Pc = −2) |
|---|---|
| u | |
| 0 | 10.1 |
| 0.003 | 8.7 |
| 0.006 | 6.3 |
| 0.009 | 5.0 |
| 0.012 | 4.6 |
| 0.015 | 3.1 |
| 0.020 | 2.5 |
| 0.030 | 2.0 |
| 0.040 | 1.8 |
| 0.050 | 1.5 |

EXAMPLE 10

Alloys having the formula: $(Nd_{0.8}Dy_{0.2})(Fe_{0.86-z}Co_{0.06}B_{0.08}Ga_z)_{5.5}$, were melted, pulverized and formed in the same manner as in Example 7. After sintering, each of them was heated at 900° C. for 2 hours and cooled down to room temperature at 1.5° C./min. It was annealed at 580° C. for 1 hour in an Ar gas flow, and rapidly quenched in water. The magnetic properties of the resulting magnets are shown in Table 15, and their irreversible losses of flux by heating at 220° C. are shown in Table 16.

TABLE 15

| | $(Nd_{0.8}Dy_{0.2})(Fe_{0.86-z}Co_{0.06}B_{0.08}Ga_z)_{5.5}$ | | | |
|---|---|---|---|---|
| z | Br(G) | bHc(Oe) | iHc(Oe) | (BH)max(MGOe) |
| 0 | 11050 | 10700 | 22500 | 29.5 |
| 0.002 | 10900 | 10600 | 23500 | 28.8 |
| 0.01 | 10600 | 10200 | 26500 | 27.2 |
| 0.03 | 10300 | 10000 | >28000 | 25.6 |
| 0.07 | 9500 | 9200 | >28000 | 21.7 |
| 0.10 | 8900 | 8600 | >28000 | 18.9 |
| 0.12 | 8500 | 8200 | >28000 | 17.0 |
| 0.15 | 8000 | 7800 | >28000 | 15.3 |

TABLE 16

| | $(Nd_{0.8}Dy_{0.2})(Fe_{0.86-z}Co_{0.06}B_{0.08}Ga_z)_{5.5}$ Irreversible Loss of Flux by Heating at 220° C. (%, Pc = −2) |
|---|---|
| z | |
| 0 | 10.1 |
| 0.002 | 7.5 |
| 0.01 | 2.7 |
| 0.03 | 0.7 |
| 0.07 | 0.5 |
| 0.10 | 0.3 |
| 0.12 | 0.1 |
| 0.15 | 0.1 |

It is shown that the addition of Ga decreases Br and (BH)max greatly, while it largely increases iHc, thereby improving the heat resistance (thermal stability) of the magnets.

EXAMPLE 11

Alloys having the formula: $(Nd_{0.9}Dy_{0.1})(Fe_{0.845-z}Co_{0.06}B_{0.08}Nb_{0.015}Ga_z)_{5.5}$, wherein z=0–0.06 were melted, pulverized and formed in the same manner as in Example 10. The magnetic properties measured are shown in Table 17, and the irreversible losses of flux measured by heating at 220° C. are shown in Table 18.

TABLE 17

| $(Nd_{0.9}Dy_{0.1})(Fe_{0.845-z}Co_{0.06}B_{0.08}Nb_{0.015}Ga_z)_{5.5}$ | | | | |
|---|---|---|---|---|
| z | Br(G) | Hc(Oe) | iHc(Oe) | (BH)max(MGOe) |
| 0 | 11850 | 11550 | 15200 | 34.1 |
| 0.01 | 11400 | 11000 | 19800 | 31.6 |
| 0.02 | 11100 | 10800 | 24900 | 29.7 |
| 0.03 | 11100 | 10600 | 28000 | 29.1 |
| 0.04 | 10800 | 10300 | >28000 | 28.0 |
| 0.06 | 10550 | 10100 | >28000 | 26.9 |

TABLE 18

| $(Nd_{0.9}Dy_{0.1})(Fe_{0.845-z}Co_{0.06}B_{0.08}Nb_{0.015}Ga_z)_{5.5}$ | |
|---|---|
| z | Irreversible Loss of Flux by Heating at 220° C. (%, Pc = −2) |
| 0 | 38.1 |
| 0.01 | 20.3 |
| 0.02 | 4.5 |
| 0.03 | 1.8 |
| 0.04 | 1.2 |
| 0.05 | 0.7 |

It is shown that even with a small amount of Dy substituted for Nd, the addition of Ga serves to improve the thermal stability of the magnets.

EXAMPLE 12

Alloys represented by the compositions of $Nd(Fe_{0.86}Co_{0.06}B_{0.08})_{5.6}$, $Nd(Fe_{0.84}Co_{0.06}B_{0.08}Ga_{0.02})_{5.6}$, and $Nd(Fe_{0.825}Co_{0.06}B_{0.908}Ga_{0.02}W_{0.015})_{5.6}$ were prepared by arc melting. The resulting ingots were coarsely pulverized by a stamp mill and a disc mill, and after sieving to finer than 32 mesh milling was carried out by a jet mill. A pulverization medium was an $N_2$ gas, and fine powders of 3.5 μm in particle size (FSSS) were obtained. The resulting powders were formed in a magnetic field of 15KOe whose direction was perpendicular to the pressing direction. Press pressure was 2t/cm$^2$. The resulting green bodies were sintered in vacuum at 1080° C. for two hours. Heat treatment was carried out at 500°-900° C. for one hour, followed by quenching. The results are shown in Table 19.

TABLE 19

| Magnetic Properties of Nd—Fe—Co—B—Ga—W Magnets | | | |
|---|---|---|---|
| Composition | 4πIr (KG) | iHc (KOe) | (BH)max (MGOe) |
| $Nd(Fe_{0.86}Co_{0.06}B_{0.08})_{5.6}$ | 13.0 | 11.2 | 40.3 |
| $Nd(Fe_{0.84}Co_{0.06}B_{0.08}Ga_{0.02})_{5.6}$ | 12.4 | 17.3 | 36.4 |
| $Nd(Fe_{0.825}Co_{0.06}B_{0.08}Ga_{0.02}W_{0.015})_{5.6}$ | 12.1 | 18.7 | 35.3 |

Figure 3:
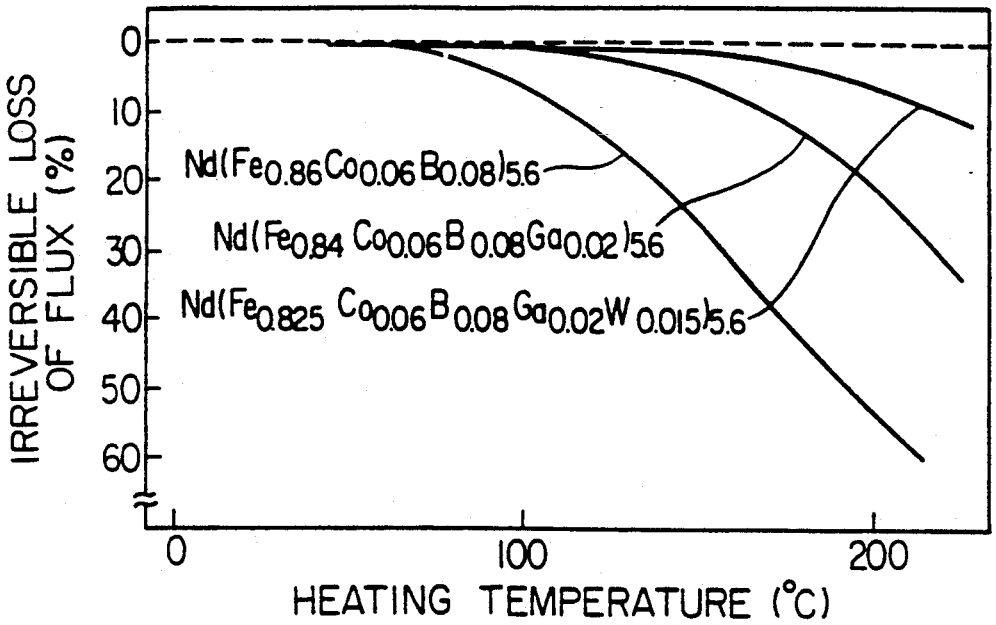
FIG. 3 is a graph showing the variations of irreversible losses of flux of Nd-Fe-Co-B, Nd-Fe-Co-B-Ga and Nd-Fe-Co-B-Ga-W magnets with heating temperatures.

And each sample was heated at various temperatures for 30 minutes, and then measured with respect to the change of open fluxes to know its thermal stability. The samples tested were those worked to have a permeance coefficiant (PC) of −2. The results are shown in FIG. 3. It is clear from FIG. 3 that the addition of Co, Ga and W in combination provides the magnets with high thermal stability.

EXAMPLE 13 pulverization, milling, sintering and heat treatment were carried out in the same manner as in Example 12 on alloys having the composition:

$Nd(Fe_{0.85-z}Co_{0.6}B_{0.08}Ga_zW_{0.01})_{5.4}$ (z=0, 0.01, 0.02, 0.03, 0.04, 0.05).

The magnetic properties of the resulting magnets are shown in Table 20.

TABLE 20

| Magnetic Properties of $Nd(Fe_{0.85-z}Co_{0.06}B_{0.08}Ga_zW_{0.01})_{5.4}$ Magnets | | | |
|---|---|---|---|
| z | 4πIr(KG) | iHc(KOe) | (BH)max(MGOe) |
| 0 | 12.6 | 12.5 | 37.8 |
| 0.01 | 12.32 | 15.2 | 35.8 |
| 0.02 | 12.06 | 17.4 | 34.7 |
| 0.03 | 11.77 | 18.5 | 33.0 |
| 0.04 | 11.52 | 19.7 | 31.7 |
| 0.05 | 11.29 | 21.0 | 29.3 |

Figure 4:
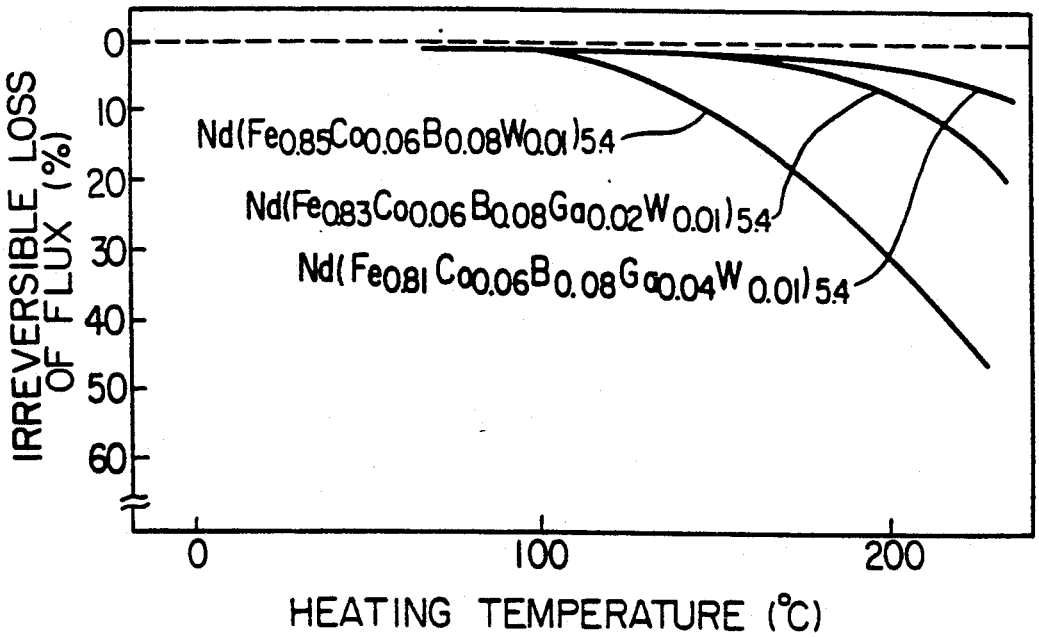
FIG. 4 is a graph showing the variations of irreversible losses of flux of $Nd(Fe_{0.85-x}Co_{0.06}B_{0.08}Ga_xW_{0.01})_{5.4}$ with heating temperatures.

The thermal stabilities o the samples of $Nd(Fe_{0.85-z}Co_{0.06}B_{0.08}Ga_zW_{0.01})_{56.4}$ (Z=0, 0.02, 0.04) were measured in the same manner as in Example 12. The results are shown in FIG. 4.

EXAMPLE 14

An alloy of the composition: $Nd(Fe_{0.825}Co_{0.06}B_{0.08}Ga_{0.02}/W_{0.015})_{6.0}$ was prepared by arc melting. The resulting alloy was rapidly quenched from its melt by a single roll method. The resulting flaky products were made into bulky ones by the following three methods:

(a) Heat treatment at 500°-700° C., blending with an epoxy resin and die molding.

(b) Heat treatment at 500°-700° c. and hot pressing.

(c) Hot isostatic pressing and flattening by upsetting.

The magnetic properties of the resulting magnets are shown in Table 21.

TABLE 21

| Magnetic Properties of $Nd(Fe_{0.825}Co_{0.06}B_{0.08}Ga_{0.02}W_{0.015})_{6.0}$ Magnets | | | |
|---|---|---|---|
| Method | 4πIr(KG) | iHc(KOe) | (BH)max(MGOe) |
| (a) | 6.0 | 22.6 | 7.1 |
| (b) | 8.0 | 20.2 | 12.6 |
| (c) | 12.4 | 15.9 | 36.0 |

Figure 5:
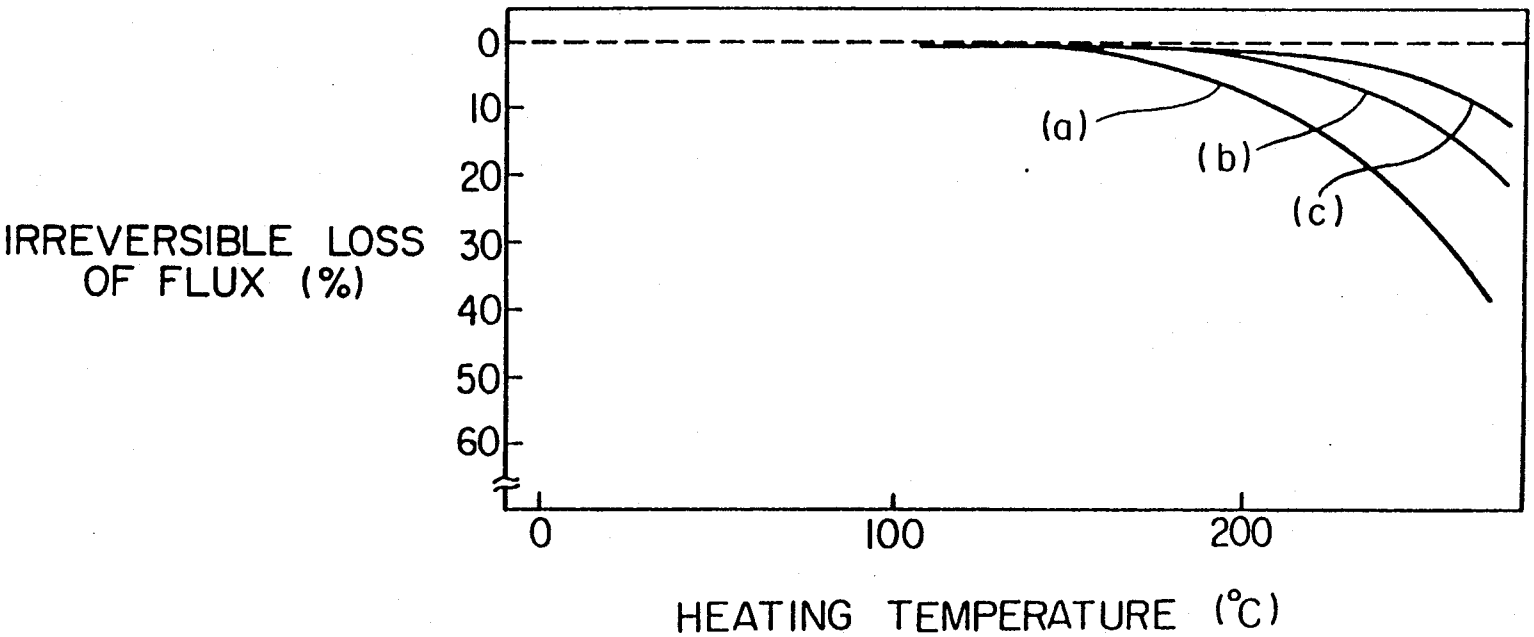
FIG. 5 is a graph showing the variations of irreversible losses of flux with heating temperatures of magnets prepared by (a) rapid quenching→heat treatment→resin bonding, (b) rapid quenching→heat treatment→hot pressing, and (c) rapid quenching→HIP upsetting.

Each sample was measured with respect to thermal stability in the same manner as in Example 12. The results are shown in FIG. 5.

EXAMPLE 15

An alloy having the composition: $Nd(Fe_{0.85}Co_{0.04}B_{0.08}Ga_{0.02}W_{0.01})_{6.1}$ was prepared by arc melting. The resulting alloy was rapidly quenched from its melt by a single roll method. The sample thus prepared was compressed by HIP, and made flat by upsetting. This bulky sample was pulverized to less than 80 μm, blended with an epoxy resin and formed in a magnetic filed. The resulting magnet had the following magnetic properties: 4πIr=8.6KG, iHc=13.2KOe and (BH)max=16.0MGOe.

EXAMPLE 16

Figure 6:
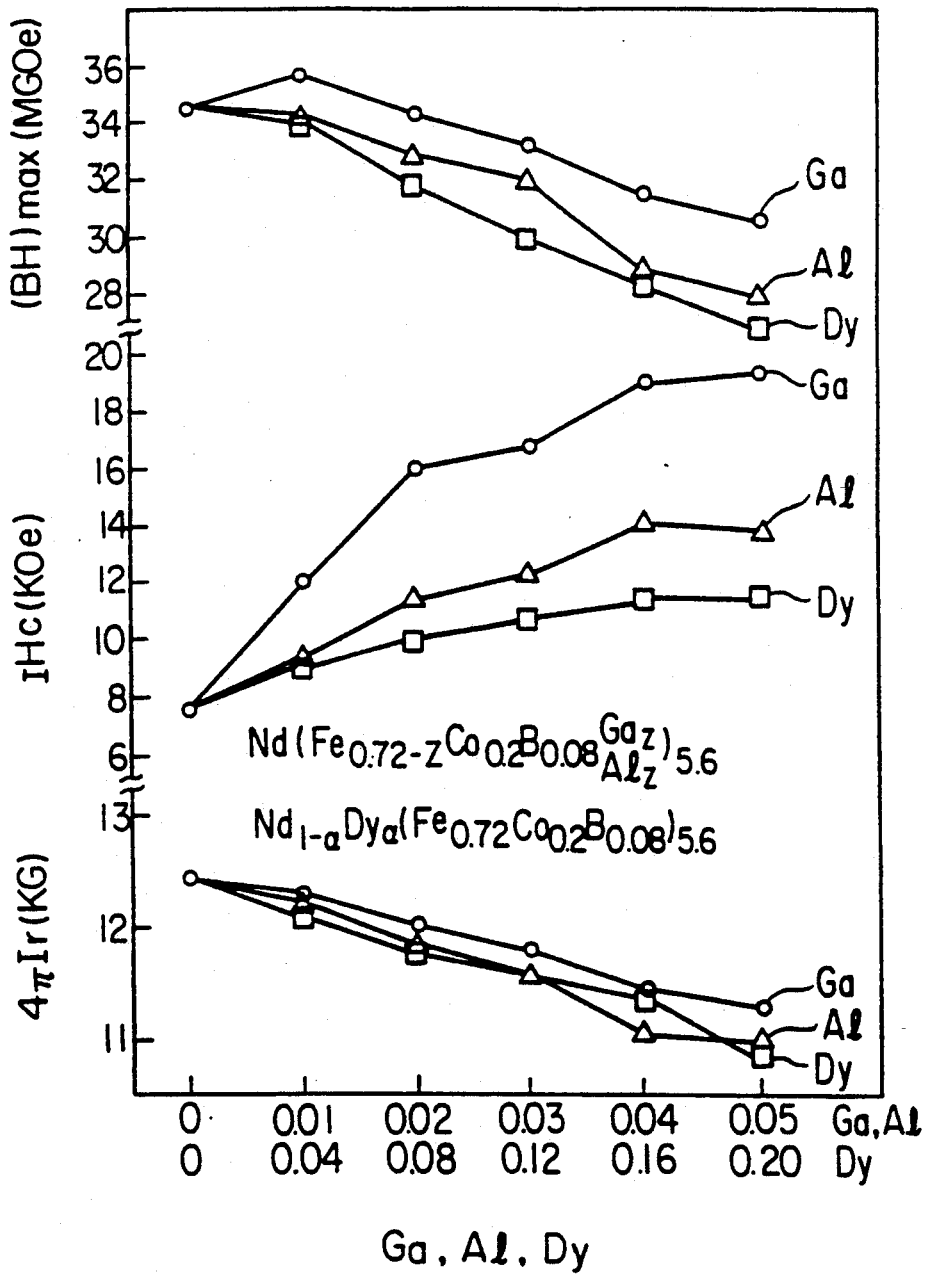
FIG. 6 is a graph showing the comparison of the magnetic properties of Nd-Dy-Fe-Co-B, Nd-Fe-Co-B-Al and Nd-Fe-Co-B-Ga magnets.

Alloys having the compositions represented by the formulae: $Nd_{1-\alpha}Dy_\alpha(Fe_{0.72}Co_{0.2}B_{0.08})_{5.6}$ (α=0, 0.04, 0.08, 0.12, 0.16, 0.2), $Nd(Fe_{0.72-z}Co_{0.02}B_{0.08}Al_z)_{5.6}$ (Z=0, 0.01, 0.02, 0.03, 0.04, 0.05), and $Nd(Fe_{0.72-z}Co_{0.2}B_{0.08}Ga_z)_{5.6}$ (Z=0, 0.01, 0.02, 0.03, 0.04, 0.05) were prepared by arc melting. The resulting ingots were coarsely pulverized by a stamp mill and a disc mill, and after sieving to finer than 32 mesh milling was carried out by a jet mill. A pulverization medium was an $N_2$ gas, and fine powders of 3.5 μm in particle size (FSSS) were obtained. The resulting powders were formed in a magnetic field of 15 KOe whose direction was perpendicular to the pressing direction. Press pressure was 1.5 t/cm$^2$. The resulting green bodies were sintered in vacuum at 1040° C,. for two hours. Heat treatment was carried out at 600°-700° C. for one hour, followed by quenching. The results are shown in FIG. 6. The magnets containing Ga had higher coercive force and smaller decrease in 4 πIr and (BH)max than those containing Dy or Al.

Figure 7:
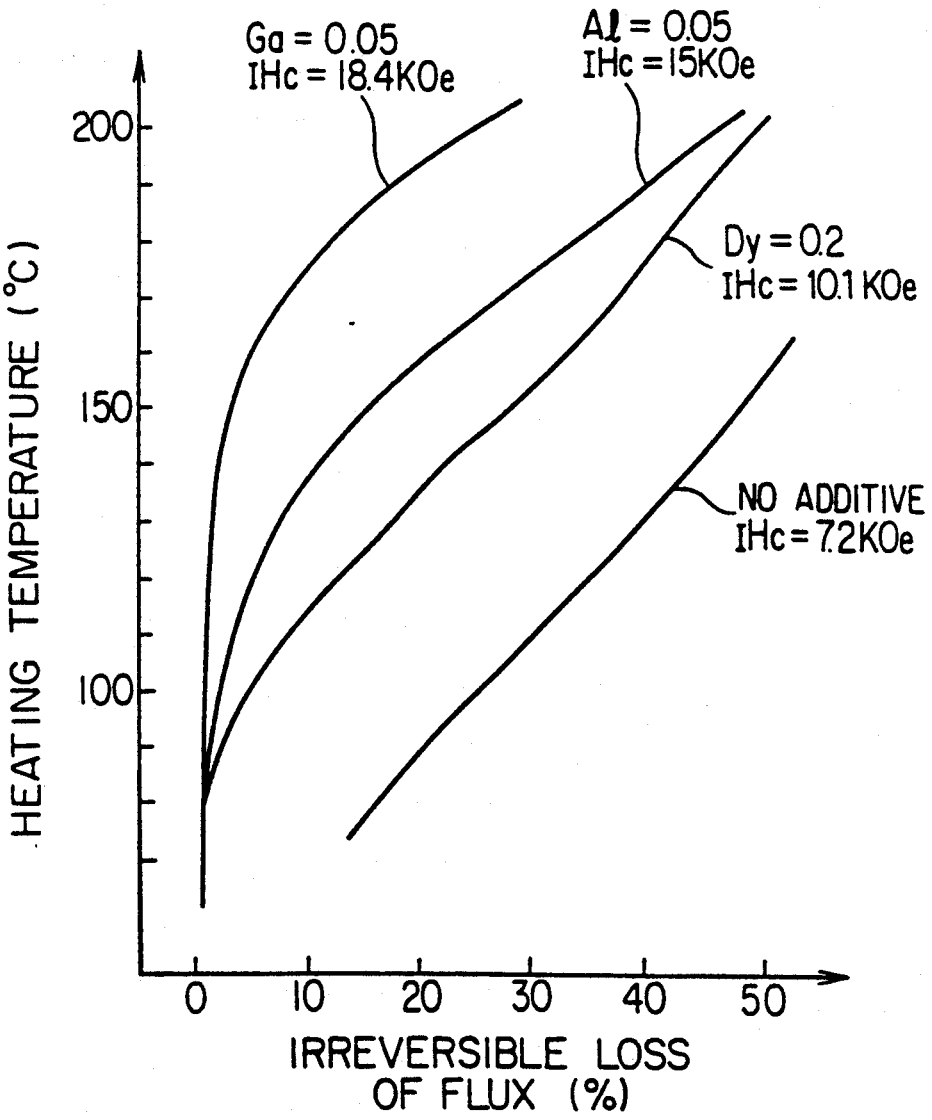
FIG. 7 is a graph showing the variations of irreversible losses of flux of $Nd(Fe_{0.72}Co_{0.2}B_{0.08})_{5.6}$, $Nd_{0.8}Dy_{0.2}(Fe_{0.72}Co_{0.2}B_{0.08})_{5.6}$, $Nd(Fe_{0.67}Co_{0.2}B_{0.08}Al_{0.05})_{5.6}$ and $Nd(Fe_{0.67}Co_{0.2}B_{0.98}Ga_{0.05})_{5.6}$ magnets with heating temperatures.
Figure 8A:
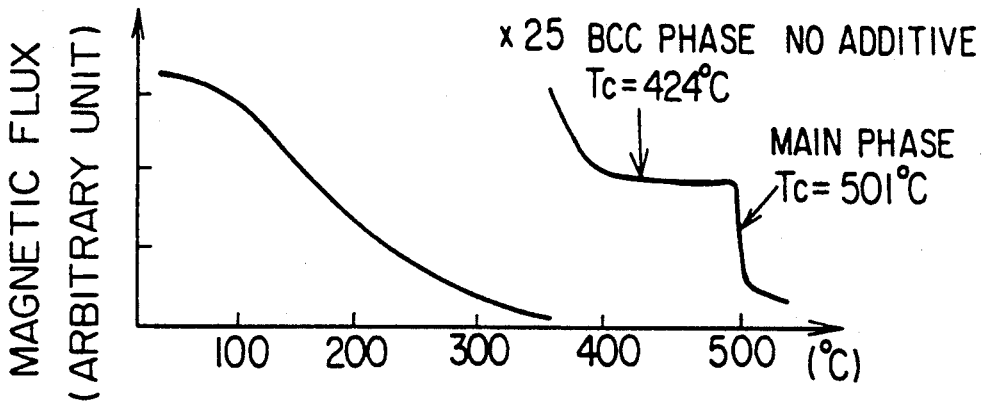
FIGS. 8(*a*)-(*d*) are graphs showing the variations of open fluxes of $Nd(Fe_{0.72}Co_{0.2}B_{0.08})_{5.6}$, $Nd_{0.8}Dy_{0.2}(Fe_{0.72}Co_{0.2}B_{0.08})_{5.6}$, $Nd(Fe_{0.67}Co_{0.2}B_{0.08}Al_{0.05})_{5.6}$ and $Nd(Fe_{0.67}Co_{0.2}B_{0.08}Ga_{0.05})_{5.6}$ magnets with heating temperatures.
Figure 8B:
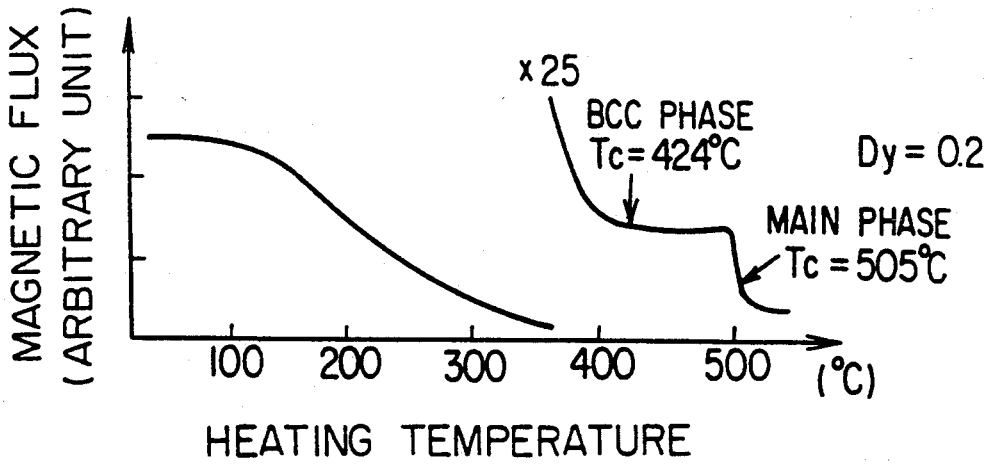
Figure 8C:
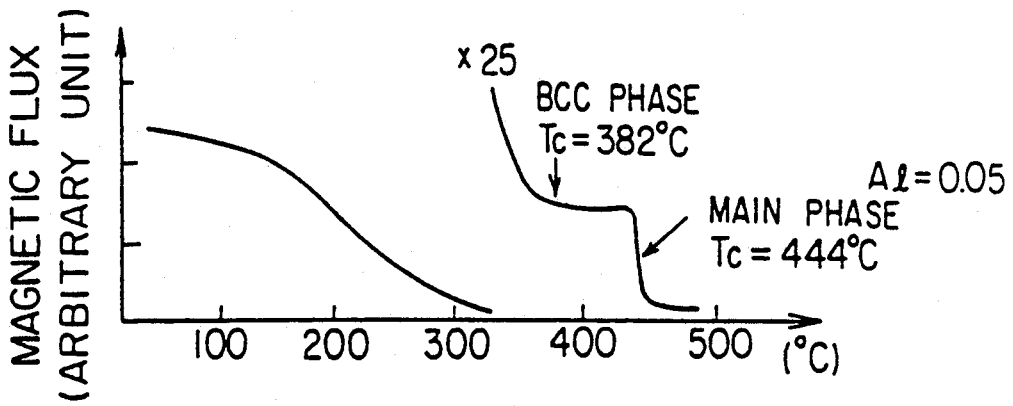
Figure 8D:
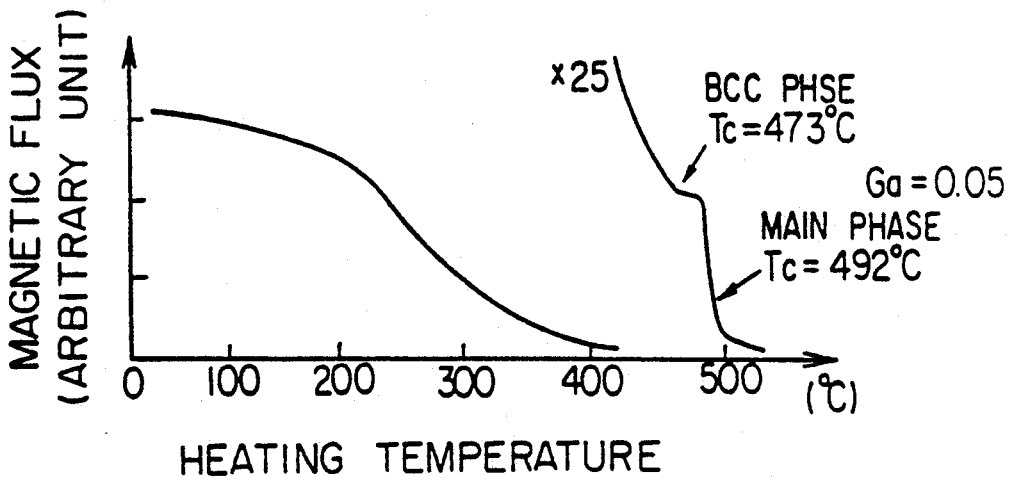
Figure 9A:
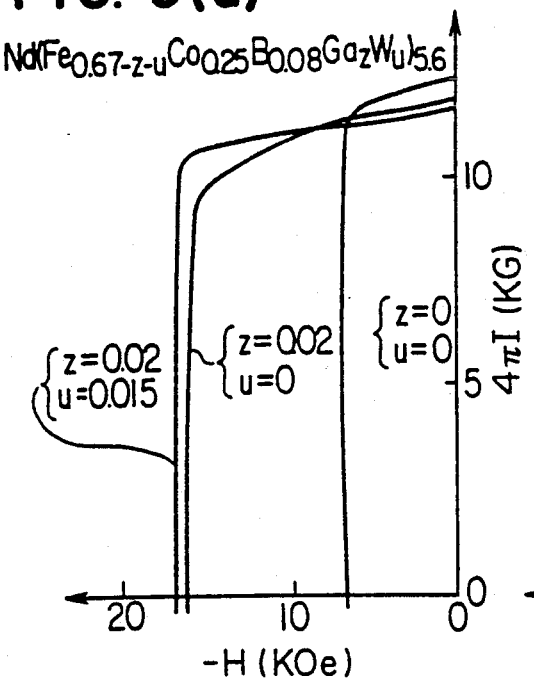
FIGS. 9 (*a*)-(*d*) are graphs showing the demagnetization curves of $Nd(Fe_{0.67-z-u}Co_{0.25}B_{0.08}Ga_zW_u)_{5.6}$, $Nd(Fe_{0.67}Co_{0.25}B_{0.08})_{5.6}$, $Nd(Fe_{0.67}Co_{0.25}B_{0.08}Ga_{0.02})_{5.6}$, and $Nd(Fe_{0.635}Co_{0.25}B_{0.08}Ga_{0.02}W_{0.015})_{5.6}$ magnets prepared at various sintering temperatures.
Figure 9B:
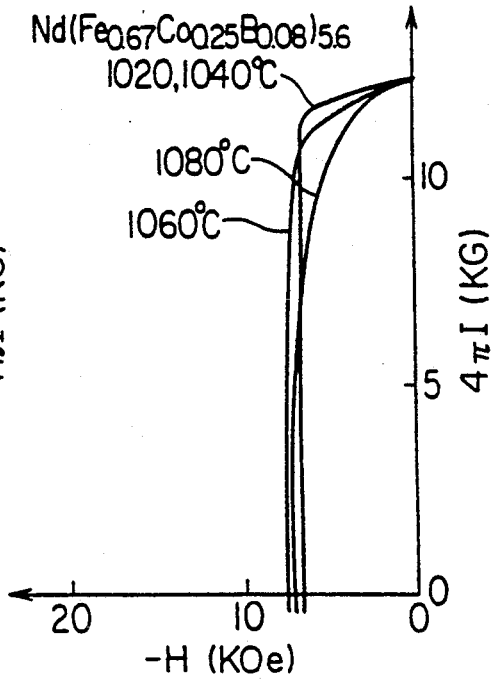
Figure 9C:
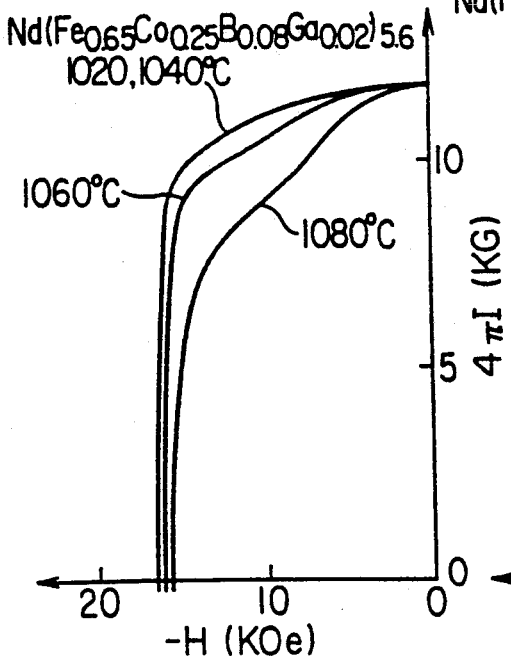
Figure 9D:
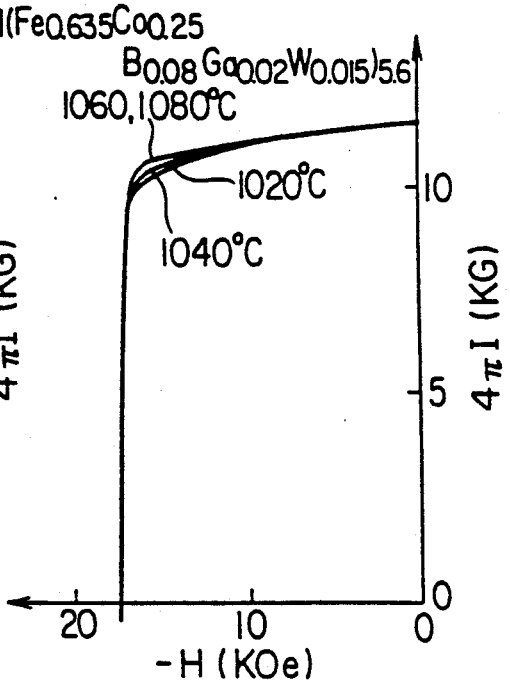

The magnets having the compositions of $Nd(Fe_{0.72}Co_{90.2}B_{0.08})_{5.6}$, $Nd_{0.8}Dy_{0.2}(Fe_{0.72}Co_{0.2}B_{0.08})_{5.6}$, $Nd(Fe_{0.67}Co_{0.2}B_{0.098}Al_{0.05})_{5.6}$ and $Nd(Fe_{0.67}co_{0.2}B_{0.08}Ga_{0.05})_{5.6}$ were worked to have a shape having a permeance coefficient Pc=−2, magnetized and have at various temperatures for 30 minutes, and ten measured with respect to the change of pen fluxes to know therein thermal stabilities. The results are shown in FIG. 7. It is shown that the variation of irreversible loss of flux with temperature depends on the coercive for e, and that the addition of Ga provides the magnet with good thermal stability, say, 5% or less of irreversible loss of flux at 160° C.

EXAMPLE 17

From the magnets of (a) $Nd(Fe_{0.72}Co_{0.2}B_{0.08})_{5.6}$, (b) $Nd_{0.8}Dy_{0.2}(Fe_{0.72}Co_{0.2}B_{0.08})_{5.6}$, (c) $Nd(Fe_{0.67}Co_{0.2}B_{0.08}Al_{0.05})_{5.6}$ and (d) $Nd(Fe_{0.67}Co_{0.2}B_{0.08}GA_{0.05})_{5.6}$ prepared in Example 16, small pieces of several millimeters in each side were taken, magnetized and measured with respect to the variations of their magnetic fluxes with temperatures by a vibration magnetometer. The measurement was carried out without a magnetic field. The results are shown in FIG. 8. The variation of magnetic flux with temperature has two inflection points; one on the side of lower temperature corresponding to the Curie temperature of the BCC phase, and the other on the side of higher temperature corresponding to the Curie temperature of the main phase. The magnets with Ga have lower Curie temperatures in their main phases than those containing no additive. On the other hand, with respect to the Curie temperature of the BCC phase, the former is higher than the latter. However, the addition of Af greatly decreases the Curie temperatures of the main phase and of the BCC phase, providing diminished thermal stability.

EXAMPLE 18

Pulverization, milling, sintering and heat treatment were carried out in the same manner as in Example 16 on alloys having the compositions:

$Nd(Fe_{0.67}Co_{0.25}B_{0.08})_{5.6}$, $Nd(Fe_{0.65}Co_{0.25}B_{0.08}Ga_{0.02})_{5.6}$, and $Nd(Fe_{0.635}Co_{0.25}B_{0.08}Ga_{0.02}W_{0.015})_{5.6}$.

The sintering temperatures were 1,020° C., 1,040° C., 1,060° C. and 1,080° C., respectively, and the magnetic properties were measured. The results are shown in FIGS. 9(*b*)-(*c*). FIG. 9(*a*) shows the comparison in demagnetization curve of the above magnets which are summarily expressed by the formula: $Nd(Fe_{0.567-z-u}Co_{0.25}B_{0.08}Ga_zW_u)_{5.6}$, wherein z=0 or 0.02 and u=0 or 0.015. As shown in FIGS. 9(*b*) and (*c*), where W is not contained, the higher the sintering temperature, the poorer the squareness of the resulting magnet, resulting in the growth of coarse crystal grains having low coercive force. On the other hand, where W is added, as shown in FIG. 9(*d*), the higher sintering temperature does not lead to the growth of coarse crystal grains, providing good squareness. FIG. 9(*a*) shows that the inclusion of Ga and W enhances the coercive force of the magnet.

EXAMPLE 19

Alloys having the composition:

$Nd(Fe_{0.69}Co_{0.2}B_{0.08}Ga_{0.02}M_{0.01})_{5.6}$, wherein M is V, Nb, Ta, Mo or W, were subjected to pulverization, milling, sintering and heat treatment in the same manner as in Example 16. The magnetic properties of the resulting magnets are shown in Table 22.

TABLE 22

Magnetic Properties of $Nd(Fe_{0.69}Co_{0.2}B_{0.08}Ga_{0.02}M_{0.01})_{5.6}$ (M: V, Nb, Ta, Mo, W)

| Composition | 4πIR (KG) | iHc (KOe) | (BH)max (MGOe) |
|---|---|---|---|
| $Nd(Fe_{0.69}Co_{0.2}B_{0.08}Ga_{0.02}V_{0.01})_{5.6}$ | 12.0 | 17.0 | 34.0 |
| $Nd(Fe_{0.69}Co_{0.2}B_{0.08}Ga_{0.02}Nb_{0.01})_{5.6}$ | 12.0 | 16.0 | 33.9 |
| $Nd(Fe_{0.69}Co_{0.2}B_{0.08}Ga_{0.02}Ta_{0.01})_{5.6}$ | 11.9 | 16.5 | 33.0 |
| $Nd(Fe_{0.69}Co_{0.2}B_{0.08}Ga_{0.02}Mo_{0.01})_{5.6}$ | 12.1 | 15.0 | 34.9 |
| $Nd(Fe_{0.69}Co_{0.2}B_{0.08}Ga_{0.02}W_{0.01})_{5.6}$ | 11.8 | 17.5 | 33.1 |

EXAMPLE 20

Alloys having the composition of $(Nd_{0.18}Dy_{0.2})(Fe_{0.85-u}Co_{0.06}B_{0.08}Ga_{0.01}Mo_u)_{5.5}$, wherein u=0-0.03 were pulverized, milled, sintered and heat-treated in the same manner as in Example 16. The resulting magnets were measured with respect to magnetic properties and irreversible loss of flux by heating at 260° C. (Pc=−2). The results are shown in Table 23.

TABLE 23

$(Nd_{0.8}Dy_{0.2})(Fe_{0.85-u}Co_{0.06}B_{0.08}Ga_{0.01}Mo_u)_{5.5}$

| u | Br(KG) | bHc(KOe) | iHc(KOe) | (BH)max (MGOe) | Irr. Loss* (%) |
|---|---|---|---|---|---|
| 0 | 11.0 | 10.5 | 26.0 | 29.4 | 16.7 |
| 0.005 | 10.8 | 10.3 | 27.0 | 28.2 | 9.0 |
| 0.010 | 10.6 | 10.2 | 28.5 | 27.0 | 4.0 |
| 0.015 | 10.5 | 10.0 | 29.0 | 26.0 | 2.1 |
| 0.02 | 10.3 | 9.8 | >30.0 | 25.2 | 1.0 |
| 0.03 | 9.8 | 9.2 | >30.0 | 22.8 | 0.9 |

Note: *Irreversible loss of flux

EXAMPLE 21

Alloys having the composition of $Nd(Fe_{0.855-u}Co_{0.06}B_{0.075}Ga_{0.01}V_u)_{5.5}$, wherein u=0-0.02 were pulverized, milled, sintered and heat-treated in the same manner as in Example 16. The resulting magnets were measured with respect to magnetic properties and irreversible loss of flux by heating at 160° C. (Pc=−2). The results are shown in Table 24.

TABLE 24

$Nd(Fe_{0.855-u}Co_{0.06}B_{0.075}Ga_{0.01}V_u)_{5.5}$

| u | Br(KG) | bHc(KOe) | iHc(KOe) | (BH)max (MGOe) | Irr. Loss* (%) |
|---|---|---|---|---|---|
| 0 | 11.9 | 11.6 | 17.9 | 34.1 | 7.6 |
| 0.005 | 11.7 | 11.2 | 18.2 | 33.2 | 6.2 |
| 0.01 | 11.6 | 11.0 | 18.3 | 32.4 | 7.9 |
| 0.015 | 11.5 | 10.9 | 19.2 | 31.9 | 4.2 |
| 0.020 | 11.4 | 10.8 | 20.5 | 31.2 | 2.1 |

Note: *Irreversible loss of flux

EXAMPLE 22

Alloys having the composition of $(Nd_{0.9}Dy_{0.1})(Fe_{0.85-u}Co_{0.067}B_{0.08}Ga_{0.01}Ta_u)_{5.5}$, wherein u=0-0.03 were pulverized, milled, sintered and heat-treated in the same manner as in Example 16. The resulting magnets were measured with respect to magnetic properties and irreversible loss of flux by heating at 160+ C. (Pc−−2). The results are shown in Table 25.

TABLE 25

$(Nd_{0.9}Dy_{0.1})(Fe_{0.85-u}Co_{0.06}B_{0.08}Ga_{0.01}Ta_u)_{5.5}$

| u | Br(KG) | bHc(KOe) | iHc(KOe) | (BH)max (MGOe) | Irr. Loss* (%) |
|---|---|---|---|---|---|
| 0 | 11.8 | 11.3 | 16.5 | 33.5 | 8.2 |
| 0.005 | 11.6 | 11.1 | 17.5 | 32.4 | 4.1 |
| 0.010 | 11.4 | 10.9 | 18.9 | 31.5 | 3.7 |
| 0.015 | 11.3 | 10.9 | 19.5 | 30.7 | 3.2 |
| 0.020 | 11.1 | 10.6 | 19.8 | 29.8 | 3.0 |
| 0.025 | 10.9 | 10.4 | 20.2 | 28.7 | 2.1 |
| 0.030 | 10.7 | 10.3 | 21.0 | 27.7 | 1.9 |

Note: *Irreversible loss of flux

As described in Examples above, the addition of Ga or Co and Ga together to Nd-Fe-B magnets increases Curie temperature and coercive force of the magnets, thereby providing magnets with better thermal stability. In addition, the addition of M (one or more of Nb, W, V, Ta, Mo) together with Co and Ga to Nd-Fe-B magnets further increases their Curie temperature and coercive force.

The present invention has been explained referring to the above Examples, but it should be noted that it is not restricted thereto, and that any modifications can be made unless they deviate from the scope of the present invention defined by the claims attached hereto.

What is claimed is:

1. A sintered permanent magnet having good thermal stability, consisting essentially of the composition represented by the general formula:

$$R(Fe_{1-x-y-z}Co_xB_yGa_z)_A$$

wherein R is Nd, part of which may be substituted by one or more elements elected from the group consisting of Pr and Ce, $0 \leqq x \leqq 0.7$, $0.02 \leqq y \leqq 0.3$, $0.001 \leqq z \leqq 0.15$ and $4.0 \leqq A \leqq 7.5$.

2. The sintered permanent magent having good thermal stability according to claim 1, wherein $0.01 \leqq x \leqq 0.4$, $0.03 \leqq y \leqq 0.2$, $0.002 \leqq z \leqq 0.1$ and $4.5 \leqq A \leqq 7.0$.

3. The sintered permanent magent having good thermal stability as in claim 2 wherein $0.05 \leqq x \leqq 0.25$, $0.04 \leqq y \leqq 0.15$, $0.005 \leqq z \leqq 0.05$, and $5.0 \leqq A \leqq 6.8$.

4. A sintered permanent magent having good thermal stability, consisting essentially of the composition represented by the general formula:

$$R_1R_2(Fe_{1-x-y-z}Co_xB_yGa_z)_A$$

wherein $R_1$ is Nd part of which may be substituted by one or more elements selected from the group consisting of Pr and Ce, wherein $R_2$ is up to about 40 atomic % of $R_1+R_2$ and $R_2$ is Dy, $0 \leqq x \leqq 0.7$, $0.02 \leqq y \leqq 0.3$, $0.001 \leqq z \leqq 0.15$ and $4.0 \leqq A \leqq 7.5$.

5. The sintered permanent magent having good thermal stability according to claim 4, wherein $0.01 \leqq x \leqq 0.4$, $0.03 \leqq y \leqq 0.2$, $0.002 \leqq z \leqq 0.1$ and $4.5 \leqq A \leqq 7.0$.

6. The sintered permanent magnet having good thermal stability as in claim 4 wherein $0.05 \leqq x \leqq 0.25$, $0.04 \leqq y \leqq 0.15$, $0.0056 \leqq z \leqq 0.05$, and $5.0 \leqq A \leqq 6.8$.

* * * * *

UNITED STATES PATENT AND TRADEMARK OFFICE

CERTIFICATE OF CORRECTION

PATENT NO. : 5,230,751

DATED : Jul. 27, 1993

INVENTOR(S) : Minoru Endoh et al

It is certified that error appears in the above-identified patent and that said Letters Patent is hereby corrected as shown below:

Claim 1, column 18, line 5, "elected" should be --selected--.

Claim 6, column 18, line 32, "0.0056" should be --0.005--.

Signed and Sealed this

Fifth Day of July, 1994

Bruce Lehman

*Attest:*

BRUCE LEHMAN

*Attesting Officer*

*Commissioner of Patents and Trademarks*